United States Patent [19]

Chiba

[11] Patent Number: 4,746,110

[45] Date of Patent: May 24, 1988

[54] DEALING PORT MECHANISM IN BANKNOTE DEPOSITING AND DISPENSING MACHINE

[75] Inventor: Teruhisa Chiba, Urawa, Japan

[73] Assignee: Laurel Bank Machines Co., Ltd., Tokyo, Japan

[21] Appl. No.: 875,541

[22] Filed: Jun. 18, 1986

[30] Foreign Application Priority Data

Jul. 2, 1985 [JP] Japan ..... 60-144941

[51] Int. Cl.[4] ..... B65H 5/00

[52] U.S. Cl. ..... 271/3.1; 271/163; 232/1 D; 206/555; 206/558

[58] Field of Search ..... 271/301, 9, 163, 3; 206/555, 556, 568; 232/1 D

[56] References Cited

U.S. PATENT DOCUMENTS

| | | | |
|---|---|---|---|
| 608,654 | 8/1898 | Daley | 232/1 D |
| 2,543,751 | 3/1951 | Atkinson | 232/1 D |
| 4,132,398 | 1/1979 | Erdmann | 271/9 |

FOREIGN PATENT DOCUMENTS

| | | |
|---|---|---|
| 109743 | 5/1984 | European Pat. Off. . |
| 3243271A | 5/1984 | Fed. Rep. of Germany . |
| 55-119775 | 9/1980 | Japan . |
| 56-33757 | 4/1981 | Japan . |
| 58-2970 | 1/1983 | Japan . |
| 59-11489 | 1/1984 | Japan . |
| 2140186A | 11/1984 | United Kingdom . |

*Primary Examiner*—Richard A. Schacher

*Attorney, Agent, or Firm*—Fleit, Jacobson, Cohn & Price

[57] ABSTRACT

A depositing port and a dispensing port are disposed adjacent to each other in a banknote depositing and dispensing machine. A slidable shutter is provided to cover the dispensing port and depositing port.

2 Claims, 2 Drawing Sheets

DEALING PORT MECHANISM IN BANKNOTE DEPOSITING AND DISPENSING MACHINE

BACKGROUND OF THE INVENTION

The present invention relates to a dealing port mechanism for depositing and dispensing banknotes in a banknote depositing and dispensing machine having the function of handling deposited banknotes and of handling banknotes to be dispensed, and more particularly to an improvement for simplifying the design of a mechanism necessary for depositing and dispensing banknotes and of a mechanism for opening and closing dealing ports, as well as for facilitating the handling thereof by clients.

Today, numerous banknote depositing and dispensing machines having the function of handling deposited banknotes and of dispensing banknotes are used.

In the early days of development, such banknote depositing and dispensing machines were so arranged that a handling machine used exclusively for depositing and a handling machine used exclusively for dispensing were merely arranged and housed together in a frame, and, as for dealing ports, one used exclusively for depositing (depositing port) and one used exclusively for dispensing (dispensing port) were arranged separately and apart from each other.

However, if the depositing port and the dispensing port are arranged apart from each other, in cases where the handling of deposited banknotes and the dispensing of banknotes are carried out continuously, a client (operator) had to give his attention to both dealing ports, and also had to change his posture or move depending on whether he wished to effect a depositing or a dispensing operation. Thus, such an arrangement presented the client with some difficulty since the handling efficiency was poor.

In addition, if a handling machine used exclusively for depositing and a handling machine used exclusively for dispensing are simply arranged and housed together in one frame, a deposited banknote storage section for storing deposited banknotes and a dispensing banknote storage section for storing banknotes ready for dispensing are both required to have a capacity equivalent to that of a conventional machine used exclusively for depositing or a machine used exclusively for dispensing, so that there was a problem in that the unavoidable tendency was for the overall machine to become large in size.

In recent years, therefore, a banknote depositing and dispensing machine has been developed which is adapted to be capable of effecting depositing and dispensing of banknotes from a single dealing port by combining the depositing port with the dispensing port, thus facilitating handling by clients. Also, another type of banknote depositing and dispensing machine has been developed in which the capacities of the deposited banknote storage section and the dispensing banknote storage section are reduced by circulating deposited banknotes to the dispensing banknote storage section so as to make immediate use of the deposited banknotes as payable ones, thereby making the machine compact.

It is true that, if an arrangement is made to effect depositing and dispensing of banknotes from a single dealing port, as described above, the machine is easy to handle and is convenient from the standpoint of the clients. On the other hand, however, it becomes necessary to make reversible the conveying direction of a conveying passage communicated with the dealing port, or to provide a delivery mechanism for delivering one by one banknotes deposited in the dealing port for the purposes of discrimination and counting, thereby making it necessary to enable the conveying passage communicated with the dealing port to carry out both the function of handling deposited bills and of dispensing bills. Hence, there has been a drawback in that the peripheral mechanisms of the dealing port which are necessary for depositing and dispensing operations unnecessarily become overly complicated.

SUMMARY OF THE INVENTION

The present invention has been devised in the light of the aforementioned situation. The object of the invention is to provide a dealing port mechanism in a banknote depositing and dispensing machine which is capable of simplifying the mechanism necessary for depositing and dispensing banknotes and the mechanism for opening and closing the dealing port and of facilitating the operation thereof by clients.

To this end, the present invention provides a dealing port mechanism for depositing and dispensing banknotes in a bill depositing and dispensing machine having the function of handling deposited banknotes and of dispensing banknotes, characterized in that a depositing port and a dispensing port are disposed adjacent to each other as dealing ports, and the opening and closing of the depositing port and the dispensing port is controlled by sliding a single shutter plate capable of covering both the depositing port and the dispensing port in the direction of the juxtaposition of the depositing port and the dispensing port, thereby overcoming the aforementioned problems of the prior art.

In such an arrangement, since the depositing port and the dispensing port are disposed adjacent to each other as dealing ports, even in cases where the handling of deposited banknotes and the dispensing of banknotes are carried out continuously, a client need not change his posture or move, irrespective of whether he is performing a depositing or dispensing operation, and operation by the client can thus be facilitated.

In addition, in the above-described arrangement, the mechanism required in handling deposited banknotes and the mechanism required in handling banknotes to be dispensed can be made independent, so that the respective mechanisms may be provided with the minimum of functions as exclusive-use mechanisms. Consequently, the mechanisms necessary for handling deposited and dispensing banknotes can be made simple, and the control thereof can be effected by a simple system.

Furthermore, in the above-described arrangement, it suffices to prepare as a mechanism for opening and closing a dealing port a reciprocating mechanism for linearly advancing and retracting the shutter plate in the direction of the juxtaposition of the depositing port and the dispensing port as well as a control unit for operating the reciprocating mechanism in response to an instruction or the like given by the client. Furthermore, it suffices if the control unit is capable of setting the amount of movement of the shutter plate and changing the moving direction thereof, so that the number of functions required of it can be made relatively small. Therefore, as a whole it becomes possible to simplify the mechanism for opening and closing the dealing ports.

In addition, in making the aforementioned arrangement, if the opening/closing timing and the like of the depositing and dispensing ports is controlled while detecting the position of the shutter plate, it becomes possible to indicate to the client by the movement of the shutter plate whether the machine is ready for a depositing or a dispensing procedure, thereby making it possible to prevent the occurrence of such inconveniences as mistaking one procedure for another.

DESCRIPTION OF THE DRAWINGS

The present invention will now be described in detail with reference to the preferred embodiment illustrated in the accompanying drawings in which.

DESCRIPTION OF THE PREFERRED EMBODIMENT

The present invention will now be described in detail with reference to the embodiment shown in the accompanying drawings.

Figure 1:
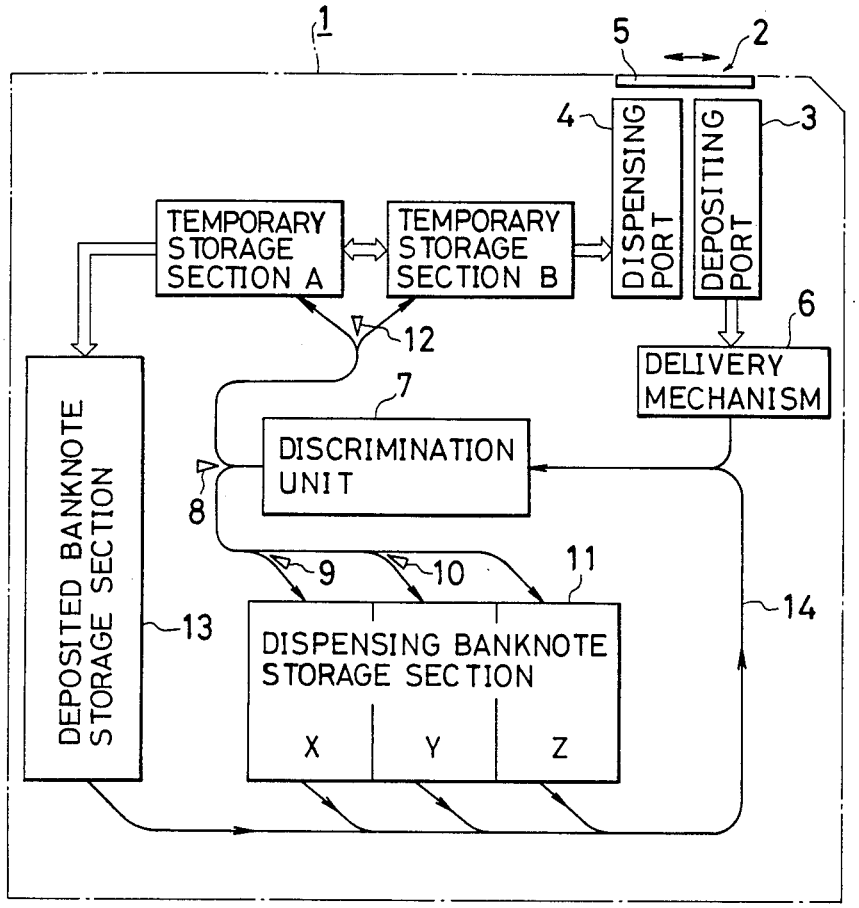
FIG. 1 is a schematic diagram of an embodiment of a circulating-type banknote depositing and dispensing machine to which the present invention is applied.

FIG. 1 shows a banknote depositing and dispensing machine to which the present invention is applied.

This banknote depositing and dispensing machine 1 has the function of handling deposited banknotes and the function of handling banknotes to be dispensed and is of a circulating type in which, after a predetermined handling of deposited bills, the deposited bills are utilized as dispensable ones. Reference numeral 2 denotes a dealing port mechanism pertaining to the present invention.

This dealing port mechanism 2 is designed to deposit and dispense banknotes in the aforementioned banknote depositing and dispensing machine 1, and is characterized in that a depositing port 3 and a dispensing port 4 are disposed adjacent to each other as dealing ports, and the opening and closing of the depositing port 3 and the dispensing port 4 is controlled by sliding a single shutter plate 5 capable of covering both the depositing port 3 and the dispensing port 4 in the direction of the arrangement of the depositing port 3 and the dispensing port 4 (horizontally as viewed in FIG. 1).

Before describing this dealing port mechanism 2 in detail, a brief description will be given of the functions of the aforementioned banknote depositing and dispensing machine 1. When a client gives an instruction for depositing banknotes and banknotes are deposited in the depositing port 3, the banknotes are delivered one by one to a delivering mechanism 6 and sent to a discriminating section 7, where the types of banknote are discriminated, judgment is made as to whether or not the banknote is acceptable, and the counting of the banknotes is carried out. The banknotes which are judged to be acceptable in the discrimination section 7 are adapted to be stored in the specified storage sections X, Y, and Z in accordance with each of the denominations provided for by means of distributing mechanisms 8, 9, and 10, or to be stored in a deposited banknote storage section 13 via distributing mechanisms 8, 12 and a temporary pool A. On the other hand, banknotes which are judged by the discriminating section 7 to be unacceptable are returned to the depositing port 4 via the distributing mechanisms 8, 12 and a temporary pool B.

In addition, when the client gives an instruction for dispensing, a specified amount of banknotes are delivered from the dispensing banknote storage section 11 to the dispensing port 4 via a route 14 passing through the discriminating section 7 and via the distributing mechanisms 8, 12 and the temporary pool B. Incidentally, this banknote depositing and dispensing machine 1 is adapted such as to be capable of moving bills contained in the deposited banknote storage section 13 to the dispensing banknote storage section 11 via the route 14, the discriminating section 7, and the distributing mechanisms 8, 9.

Figure 2:
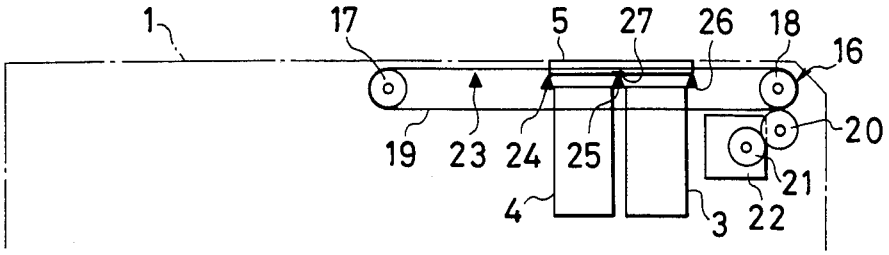
FIG. 2 is an explanatory diagram of the arrangement of essential portions of the banknote depositing and dispensing machine illustrated in FIG. 1.

As shown in FIG. 2, the dealing port mechanism installed in such a banknote depositing and dispensing machine 1 supports a shutter plate 5 in the direction of the juxtaposition of the depositing port 3 and the dispensing port 4 (horizontally as viewed in FIG. 2, and hereinafter referred to as the opening and closing direction), and controls the advancing and retracting of the shutter plate 5 in the opening and closing direction thereof by means of a reciprocating mechanism 16.

The reciprocating mechanism 16 is arranged such that a portion of the shutter plate 5 is connected to an endless belt 19 or the like (a chain or a wire means is also usable) which is mounted on rotary members 17, 18, which are pulleys or sprockets or the like, in the opening and closing direction of the shutter plate 5, and the belt 19 is rotatably driven by a motor 22 via power transmitting rotary members 20, 21, thereby advancing or retracting the shutter plate 5 in the opening and closing direction. The amount of rotation of the motor 22 in the rotating direction thereof is controlled on the basis of the detected values of four position detecting sensors 23, 24, 25, and 26 disposed below the shutter plate 5 and spaced in the opening and closing direction of the shutter plate 5.

The position detecting sensors 23, 24, 25, and 26 detect the position of the shutter plate 5 by detecting the position of a reference position 27 set on the underside of the shutter plate 5, and are arranged such that the movement of the shutter plate 5 is controlled on the basis of the detected values of these position detecting sensors 23, 24, 25, and 26, and normally (when they are not used for depositing and dispensing banknotes) both of the depositing port 3 and the dispensing port 4 are in the closed state, but both of the dealing ports can be opened simultaneously, or either one can be opened, as necessary.

Hereinafter, an embodiment of the opening and closing control of each dealing port 3, 4 of the dealing port mechanism 2 will be described with reference to FIGS. 3 (*a*) to (*c*) and FIGS. 4 (*a*) to (*d*).

Figure 3A:
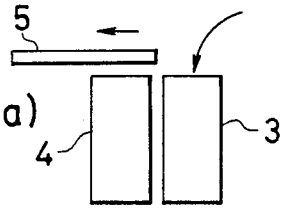
FIGS. 3 (*a*) to (*c*) are diagrams explaining one embodiment of controlling the operations of opening and closing a shutter plate, and FIGS. 4 (*a*) to (*d*) are diagrams explaining another embodiment of controlling the operations of opening and closing the shutter plate.
Figure 4A:
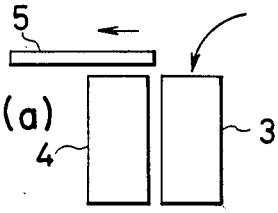
Figure 3B:
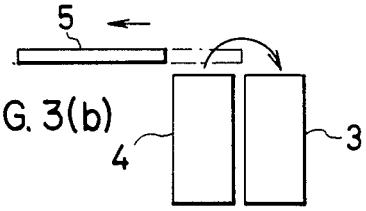
Figure 4B:
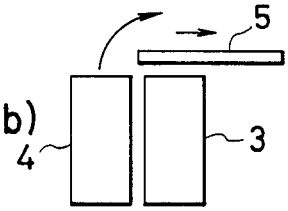
Figure 3C:
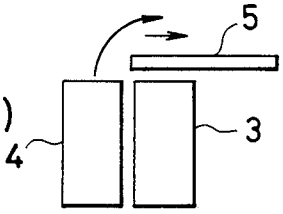
Figure 4C:
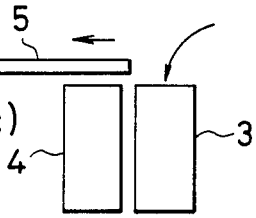
Figure 4D:
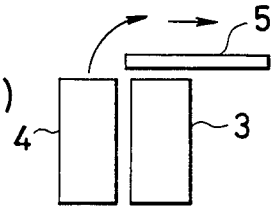

FIGS. 3 (*a*) to (*c*) show one embodiment of controlling the operations of opening and closing the shutter plate 5. Each drawing will be explained in sequence. When the client gives an instruction for depositing banknotes, the shutter plate 5 first moves to the side of the dispensing port 4 and opens only the depositing port 3, as shown in FIG. 3 (*a*). In this case, the position where the shutter plate 5 stops is the position where the aforementioned reference position 27 is located immediately above the position detecting sensor 24, and the motor 22 is stopped by a detecting signal of the position detecting sensor 24.

Next, banknotes are deposited in the depositing port 3, the shutter plate 5 is returned to its original position, and the depositing port 3 and the dispensing port 4 are both closed, upon which the handling of deposited banknotes starts. Of the deposited banknotes, those banknotes that are judged in the discrimination section to be unacceptable (i.e., rejected banknotes) are returned to the client through the dispensing port 4.

Provisions are made for two cases with regard to the return of rejected banknotes.

One is the case where a rejected banknote which is returned to the dispensing port 4 is redeposited in the depositing port 3 by the client and rediscriminated. In this case, as shown in FIG. 3 (*b*), when the rejected banknote is returned, the shutter plate 5 moves to the outside of the dispensing port 4 as far as it can so as to open both the depositing port 3 and the dispensing port 4. In this case, the position where the shutter plate 5 stops is the position where the reference position 27 is located immediately above the position detecting sensor 23, and the motor 22 is stopped by a detecting signal of the position detecting sensor 23. In this case, when the banknote returned to the dispensing port 4 is taken out by the client, an arrangement may be provided to close the dispensing port 4, as shown by the single-dot chain line in FIG. 3 (*b*).

The other is in the case where a rejected banknote returned to the dispensing port 4 is not rediscriminated. In this case, as shown in FIG. 3 (*c*), the shutter plate 5 moves to the side of the depositing port 3, and only the dispensing port 4 is opened. In this case, the position where the shutter plate 5 stops is where the reference position 27 is located immediately above the position detecting sensor 26, and the motor 22 is stopped by a detecting signal of the position detecting sensor 26.

Incidentally, the control of the operations of opening and closing the shutter plate 5 at the time of depositing can be effected as shown in FIGS. 4 (*a*) to (*d*).

FIG. 4 (*a*) shows a state at the time when the client deposits banknotes, while FIG. 4 (*d*) shows a case where a rejected banknote returned to the client from the dispensing port 4 is not rediscriminated. These states are the same as those shown in FIG. 3. In the embodiment shown in FIGS. 4 (*a*) to (*d*), however, when rediscriminating a rejected bill, the rejected bill is taken out by opening only the dispensing port 4, as shown in FIG. 4 (*b*), and then only the depositing port 3 is opened to redeposit the banknote, s shown in FIG. (*c*). As compared with the control shown in FIGS. 3 (*a*) to (*c*), in which both dealing ports are opened in rediscriminating a rejected banknote, the control illustrated in FIGS. (*a*) to (*d*) is capable of indicating the confirmation procedure more clearly to the client.

The above is a description of the control of the operations of opening and closing the shutter plate 5 at the time of depositing banknotes. Regarding the dispensing of banknotes, since it suffices if the state shown in FIG. 3 (*c*) or FIG. 4 (*d*) is established, description thereof will be omitted.

According to the dealing port mechanism 2 having the above-described arrangements, since the depositing port 3 and the dispensing port 4 are disposed adjacent to each other, even if the handling of deposited banknotes and the dispensing of banknotes are carried out continuously, the client need not change his posture or move, irrespective of whether he is performing a depositing or dispensing operation, and handling by the client can thus be facilitated.

In addition, in the above-described dealing port mechanism 2, the mechanism required in handling deposited banknotes and the mechanism required in handling banknotes to be dispensed can be made independent, so that the respective mechanisms may be provided with the minimum of functions as exclusive-use mechanisms. Consequently, the mechanisms necessary for handling deposited and dispensing banknotes can be made simple, and the control thereof can be effected by a simple system.

Furthermore, in the above-described dealing port mechanism, it suffices to prepare as a mechanism for opening and closing a dealing port the reciprocating mechanism 16 for linearly advancing and retracting the shutter plate 5 in the direction of the juxtaposition of the depositing port 3 and the dispensing port 4 as well as a control unit for operating the reciprocating mechanism 16 in response to an instruction or the like given by the client. Furthermore, it suffices if the control unit is capable of setting the amount of movement of the shutter plate 5 and changing the moving direction thereof, so that the number of functions required of it can be made relatively small. Therefore, as a whole it becomes possible to simplify the mechanism for opening and closing the dealing port.

In addition, in making the aforementioned arrangement, if the opening/closing timing and the like of the depositing and dispensing ports 3, 4 is controlled while detecting the position of the shutter plate 5, it becomes possible to indicate to the client by the movement of the shutter plate whether the machine is ready for a depositing or a dispensing procedure, thereby making it possible to prevent the occurrence of such inconveniences as mistaking one procedure for another.

In the aforementioned embodiments, although the banknote depositing and dispensing machine 1 of a circulating type has been illustrated, the dealing port mechanism 2 of the present invention can be used as a banknote depositing and dispensing machine of a non-circulating type in which deposited banknotes are not utilized as payable ones.

As is apparent from the foregoing description, the present invention provides a dealing port mechanism for depositing and dispensing banknotes in a banknote depositing and dispensing machine having the function of handling deposited banknotes and of handling banknotes to be dispensed, and since a depositing port and dispensing port are disposed adjacent to each other as dealing ports, even in cases where the handling of deposited banknotes and the dispensing of banknotes are carried out continuously, the client need not change his posture or move, irrespective of whether he is performing a depositing or dispensing operation, and operation by the client can thus be facilitated.

In addition, since the depositing port and the dispensing port are provided separately, the mechanism required in handling deposited banknotes and the mechanism required in handling banknotes to be dispensed can be made independent, so that the respective mechanisms may be provided with the minimum of functions as exclusive-use mechanisms. Consequently, the mechanisms necessary for handling deposited and dispensing banknotes can be made simple, and the control thereof can be effected by a simple system.

Furthermore, in the dealing port mechanism of the present invention, since the operations of opening and closing the depositing port and the dispensing port are controlled by sliding the single shutter plate capable of covering both the depositing port and the dispensing port in the direction of juxtaposition of the depositing and dispensing ports, it suffices to prepare as the mechanism for opening and closing the dealing ports the reciprocating mechanism for linearly advancing and retracting the shutter plate in the direction of the juxtaposition of the depositing port and the dispensing port as well as a control unit for operating the reciprocating mechanism in response to an instruction or the like given by the client. Furthermore, it suffices if the control unit is capable of setting the amount of movement of the shutter plate and changing over the moving direction thereof, so that the number of functions required of it can be made relatively small. Therefore, it becomes possible to simplify the mechanism for opening and closing the dealing ports as a whole.

In addition, in controlling the aforementioned reciprocating mechanism, if the opening/closing timing and the like of the depositing and dispensing ports is controlled while detecting the position of the shutter plate, it becomes possible to indicate to the client by the movement of the shutter plate whether the machine is ready for a depositing or a dispensing procedure, thereby making it possible to prevent the occurrence of such inconveniences as mistaking one procedure for another.

What is claimed is:

1. A dealing port mechanism for depositing and dispensing bills in a bill depositing and dispensing machine, said dealing port mechanism comprising:

a depositing port, a dispensing port located adjacent to said depositing port, a single shutter plate slidably mounted above said depositing port and said dispensing port so as to be movable above said depositing port and said dispensing port, a plurality of sensors for detecting the position of said shutter plate and for generating position signals, means for slidably moving said shutter plate in a direction above said depositing port and said dispensing port in accordance with a desired mode of operation, and each of said position signals being used by said moving means for moving said shutter plate to a desired position, said moving means moving said shutter plate between a first position where at least one of said depositing port and said dispensing port are covered, and a second position where at least one of said depositing port and said dispensing port are open.

2. A dealing port mechanism according to claim 1, wherein said moving means includes a belt and a motor for driving said belt, said shutter plate being attached to said belt.

* * * * *